US006043597A

United States Patent [19]

Fichtler et al.

[11] Patent Number: 6,043,597

[45] Date of Patent: Mar. 28, 2000

[54] COLOR PICTURE TUBE HAVING A MASK OF A FIRST MATERIAL CONNECTED TO A FRAME OF A SECOND MATERIAL BY PLURAL WELD SPOTS

[75] Inventors: Heiko Fichtler, Notzingen; Stefan Fischer; Rolf Reidinger, both of Ebersbach; Werner Wolfram, Kirchheim/Teck-Nabern, all of Germany

[73] Assignee: Matsushita Electronics (Europe) GmbH, Esslingen, Germany

[21] Appl. No.: 09/015,969

[22] Filed: Jan. 30, 1998

[30] Foreign Application Priority Data

Jan. 30, 1997 [EP] European Pat. Off. ..... 97 101 498

[51] Int. Cl.[7] ..... H01J 29/80

[52] U.S. Cl. ..... 313/402; 313/407; 313/404

[58] Field of Search ..... 313/402–409, 313/461, 476

[56] References Cited

U.S. PATENT DOCUMENTS 3,855,493 12/1974 Snook et al. ..... 313/402

5,576,595 11/1996 Inou ..... 313/402

FOREIGN PATENT DOCUMENTS 0 063 322 10/1982 European Pat. Off. .

0 518 249 12/1992 European Pat. Off. .

2 134 436 12/1972 France .

25 49 732 5/1977 Germany .

25 49 789 5/1977 Germany .

*Primary Examiner*—Nimeshkumar D. Patel

*Assistant Examiner*—Joseph Williams

*Attorney, Agent, or Firm*—Wenderoth, Lind & Ponack, L.L.P.

[57] ABSTRACT

A color picture tube having a mask-frame combination which consists of a rectangular frame of a first material and of a mask of a second material, wherein the mask is connected to the frame by a plurality of welding spots, and notches and decoupling slots whose dimensions have a specific ratio with one another are provided at both sides of welding spots at the shorter sides.

16 Claims, 2 Drawing Sheets

COLOR PICTURE TUBE HAVING A MASK OF A FIRST MATERIAL CONNECTED TO A FRAME OF A SECOND MATERIAL BY PLURAL WELD SPOTS

BACKGROUND OF THE INVENTION

The present invention relates to a color picture tube having a mask-frame combination which includes a mask and a frame formed of first and second materials, respectively, and connected by a plurality of welding spots.

In color picture tubes, three primary color pictures are pixelwise superimposed by juxtaposing the color points pertaining to one pixel. At a sufficiently great viewing distance, the pointed structure will no longer be perceived by the eye and the colors will be mixed in an additive manner. The electron beams of the three beam generating systems of color picture tubes or color screens impinge on the phosphor stripes or phosphor dots that are arranged on the phosphor screen. To make sure that only the electron beam of one of the three electron-beam generating systems for the three primary colors impinges on the phosphor stripes or phosphor dots of the corresponding color, use is made of shadow masks which "shadow" the two other electron beams. About 80% of the electrons that are emitted by the beam generating systems impinge on the shadow mask. This will heat and thus expand the shadow mask, whereby holes might be displaced with respect to their position relative to the phosphor stripes or phosphor dots.

The shadow mask or also mask consists of a thin, low-carbon iron sheet or iron alloys. Nowadays, the masks are often made from iron-nickel alloys which in comparison with iron have a very small thermal expansion at low temperatures due to magnetostriction. The mask has etched thereinto about 400,000 holes which are assigned to the approximately 600 color stripe triples or to the approximately 400,000 color point triples, i.e., phosphor stripes or phosphor dots arranged in groups of three with a respective red, green and blue luminescent stripe or dot.

To give the thin shadow mask a certain mechanical stability and in order to make it manageable, the curved shadow mask is welded into or onto the mask frame. In modern color picture tubes, the frame is also made from thin sheet metal. The shadow mask with frame and suspension must be at least so stable that the picture tube will withstand a maximally tolerable acceleration of 35 g. Since iron-nickel alloys are much more expensive than iron, the mask frame (or also frame) is made from iron, whereas the mask consists of an iron-nickel alloy.

When such masks are drawn from sheets, a mask flange will be formed and the mask surface will become arched. The mask flange is connected by a plurality of welding spots to the frame. It is difficult to connect a mask and a frame that are made from materials having different coefficients of thermal expansion. During heating of the mask-frame combination the mask might become deformed, and such deformation will change the positions of the holes in the mask relative to the spatial positions of the associated phosphor stripes or phosphor dots. Particularly on account of the different thermal expansion characteristics of the mask and the frame during thermal manufacturing processes and during operation of a color picture tube or a color screen, it is only a loose coupling that is desired. On the other hand, a great stiffness is desired for the connection established between the mask and the frame, so that the mask will not become deformed upon impacts and will not be induced to vibrate by the sound waves of the loudspeaker of a television set.

Attempts have been made to simultaneously meet such conflicting demands by using stiffening beads in the mask, decoupling slots or recesses in the mask frame and by the placing of the welding spots.

EP-A1 063 322 suggests a solution which is concerned with an iron mask having an iron frame, with the mask being welded outside the frame. As a result, a formerly necessary manufacturing step (temperature treatment (stabilization) in a through-type furnace) can be dispensed with. The positions of the welding spots at the longer and shorter sides of the frame only permit specific areas at each side in addition to the corner points for the application of welding spots for receiving the stresses in the material that arise or remain during temperature treatments (for instance black stabilization, frits) by way of deformations which from a functional point of view are still admissible and remain within the elastic range. Such welding spots must be within a specific height range of the mask edge which, just like the other indicated ranges, depends on the diagonal length of the mask. Moreover, decoupling requires notches, recesses or beads which remove mechanical stresses at both sides from the welding spots provided at the comers of the mask. A surrounding bead which is provided above the mask edge serves the same purpose.

EP A2 0518 249 suggests another solution for masks of iron-nickel alloys with iron frames, wherein the mask is welded outside the frame. A total of twelve welding spots are used for connecting the frame and the mask so as to weld the mask flange to the outside of the frame. The welding spots are respectively positioned at the corners and approximately in the center of each side. In addition, welding spots are respectively provided at the longer sides between the central welding spot and the welding spot in the corner in an area near the central welding spot. Moreover, the welding spots are placed as close as possible to the free end of the mask flange, and each of the recesses occupies almost the whole area between the welding spots.

SUMMARY OF THE INVENTION

It is the object of the present invention to avoid permanent deformations of a mask caused by a weakening of the inherent stability of a mask-frame combination comprising a mask of iron-nickel alloy and a frame of iron in the case of which the mask flange is welded to the inside of the frame, so as to compensate for differences in longitudinal variation in an elastic manner and to maintain stability at the same time for withstanding mechanical loads.

This object is achieved by a color picture tube comprising a mask-frame combination which includes a rectangular frame (1) of a first material and a mask (2) of a second material, with the mask being connected to the frame by a plurality of welding spots and having a mask flange (70), wherein the mask-frame combination has a pair of longer sides and a pair of shorter sides, and each of the shorter side has one of the welding spots (SP3, SP8), and wherein notches (1) are provided at both sides of the welding spot (SP3, SP8) of each of the shorter sides, with approximately the following ratio being applicable for a maximum depth (H2−H3) of each of the notches relative to a distance (H3) from an upper edge (13) of the mask flange (7) to a height (H2) of the mask flange (7): H3/H2=1/3. In the above equation, H3 equals the distance between the maximum depth of each of the notches (1) and the upper edge (13) of the mask flange (7); and H2 equals the height of the mask flange (7).

As a result, the mask can be welded into the frame before the black stabilization process, and an additional handling during the separate blackening of the mask and the frame can thus be dispensed with. Moreover, an additional temperature treatment of the mask-frame combination in the associated glass trough in a through-type furnace (stabilization) can be dispensed with.

To compensate for differences in the longitudinal variation of the frame and the mask in the case of temperature rises in an elastic manner, notches and decoupling slots are provided at both sides of the welding spots at the shorter sides of the mask. Thanks to such notches, the contours at the sides of such welding spots are not subjected to any permanent changes in contour after the joint black stabilization of the mask-frame combination in the blackening furnace, especially when the size ratios according to the present invention are additionally taken into account. The deeper the notches are, the greater is the elasticity effect. With an increasing depth of the notch, the stability of the mask is reduced at the same time. If the depth of the notches according to the present invention is not exceeded, the mask stability will not deteriorate either. With the depth of the notches according to the invention, a stability of the mask which is as high as possible is therefore achieved together with an elasticity of the mask that is as great as possible.

It is especially advantageous to combine a high stability with a great elasticity of the mask when decoupling slots are provided in addition to the notches further away from the welding spots wherein the decouping slots preferably become smaller when located further away from the notches.

Moreover, the elasticity of the mask can be increased with an increasing width and number of the notches and decoupling slots. At the same time, the stability of the mask can be increased with an increasing width of the remaining mask flange at the location of the welding spots and an increasing width between the notches and decoupling slots. A suitable combination of such influencing factors is important for achieving the present object.

A stable connection of the mask and the frame can be achieved with a minimum number of welding spots on condition that welding spots are respectively provided near the center of the longer sides in addition to those in the corners and to a respective one in the center of the shorter side.

BRIEF DESCRIPTION OF THE DRAWINGS

An embodiment of the present invention shall now be explained in more detail with reference to the drawings, in which.

DETAILED DESCRIPTION OF THE INVENTION

The figures show a mask, frame combination consisting of a mask frame 1 and a mask 2. The mask which is provided with holes or mask slots 3 for permitting the passage of only part of the electrons for the phosphor stripes or phosphor dots of the primary colors on the inside of the front screen glass, is preferably made from an iron-nickel alloy with 36% of nickel (FeNi36, Invar) and a small coefficient of thermal expansion. Up to a temperature of about 60° C. the coefficient of expansion of the iron-nickel alloy is less than one tenth below that of iron. Depending on the exact alloy composition of the iron-nickel alloy, the Curie point is normally between 200° C. and 300° C. Above the Curie point the expansion of an iron-nickel alloy substantially corresponds to that of iron. Further uniform heating of mask and frame will create further differences in longitudinal variation only because of a different rapid rise in temperature caused by the different masses of the frame and the mask, as is already the case before the Curie point is reached. The cooling process also produces differences in longitudinal variation caused by the different cooling characteristics and the different thermal expansion coefficients of the mask and the frame.

The mask-frame combination is attached ("buttoned") to a picture tube trough via laterally mounted thermal bimetal springs. One of the springs is additionally provided with a centering disc.

Figure 1:
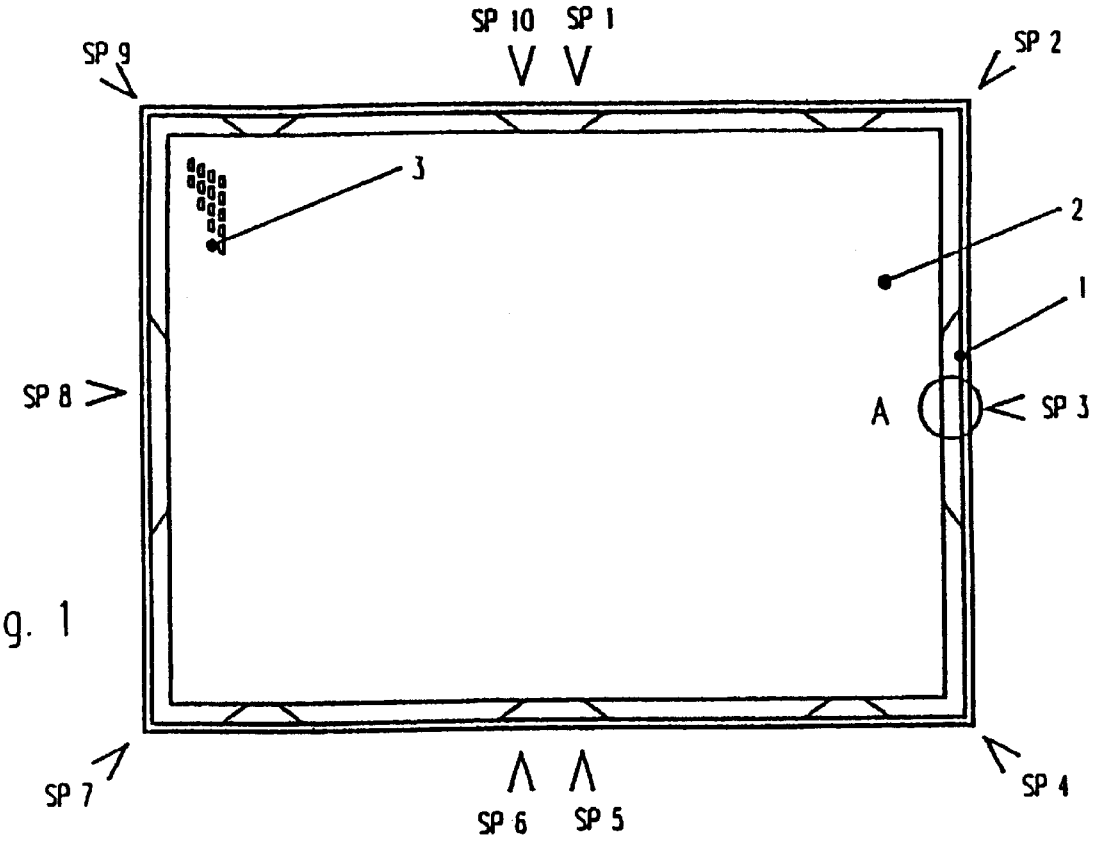
FIG. 1 is a top view of a mask-frame combination with indications of the locations to which welding spots are preferably applied.

To increase mechanical stability and operability, the thin slot or shadow mask is welded to the mask frame. The masks can be put over the frame and welded extemally. In the present embodiment the mask is welded internally. The welding spots between the mask and the frame will then connect the mask flange and the inner surface of the frame. A total of ten welding spots SP1 to SP10 are situated at the locations marked by an arrow head in FIG. 1. Four welding spots (SP2, SP4, SP7, SP9) are thus arranged in the comers of the combination. Two further welding spots SP5, SP6 and SP10, SP1, respectively, are situated on each of the long sides and are arranged near the center. The mask flange areas at the long sides can thus elastically deform between the welding spots in the center and the welding spots in the comers by taking small manufacturing efforts, i.e. without any additional recesses provided in the mask flange and without any permanent deformations. One welding spot is respectively arranged at each of the shorter sides, preferably in the center.

To increase the stiffness of the mask, the mask is provided above the mask flange with a surrounding stiffening bead 5.

Figure 2:
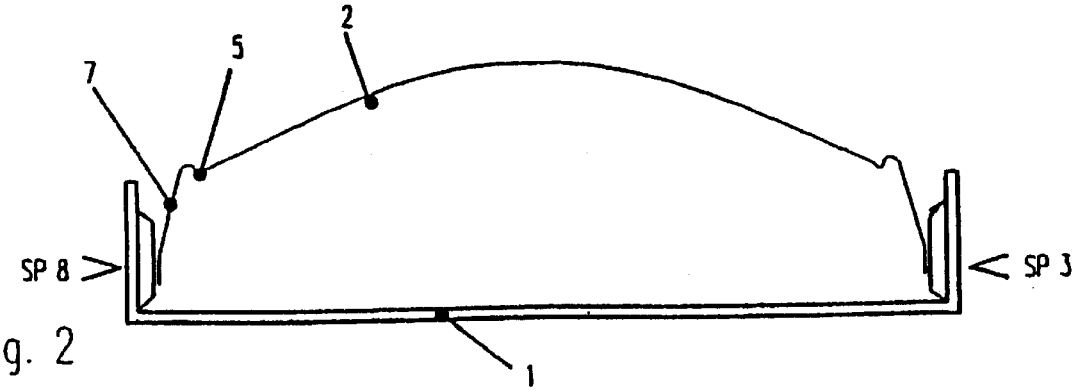
FIG. 2 is a longitudinal section taken through the mask-frame combination shown in FIG. 1, along a line from a welding spot SP8 to a welding spot SP3.
Figure 3:
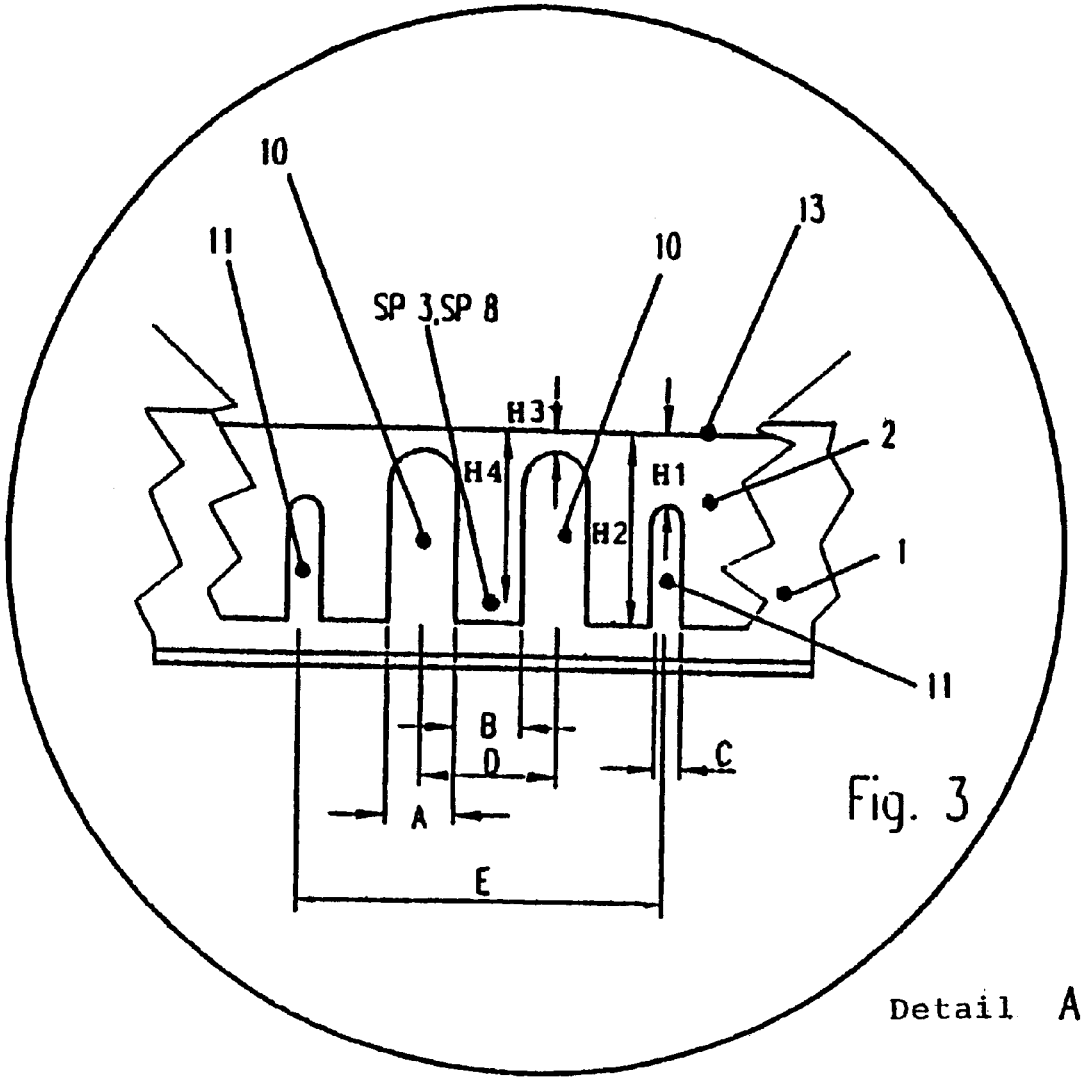
FIG. 3 is a top view of the welding spots SP3 and SP8 (detail A of FIG. 1).

The mask flange 7 (FIG. 2 exaggerates the height of the flange in comparison with the width of the mask) is provided around the central welding spots at the shorter sides with notches and decoupling slots to give the mask flange areas a relatively great freedom of movement around the welding spots. To combine maximum stability with maximum elasticity, the notches 10 and decoupling slots 11 are designed as shown in FIG. 3. To this end notches are provided at both sides of the welding spots SP3 and SP8 and additional decoupling slots are provided at some distance from the sides of the notches 10 that face away from the welding spot. Both the notches 10 and the decoupling slots 11 are preferably shaped as arches. However, it is also possible to use any desired shapes that taper in their width with an increasing depth, i.e. at an increasing distance from the outer mask edge.

The depth (H2−H3) of the notches 10 is of particular importance in attaining the necessary stability and elasticity in an especially satisfactory manner. It has been found that a ratio of 3:1 between the height H2 of the mask flange and the remaining height H3 of the mask flange at the point where the depth of notches 10 is maximum meets the conflicting demands in a particularly satisfactory manner.

Further improvements will be achieved when the width ratios of the notches 10 comply with specific size ratios. The width B of the remaining mask flange between the notches 10 that are adjacent to the welding spots SP3 and SP8, and the width A of the notches 10 should have the following ratio:

$$A/B=2/3.$$

Moreover, to achieve a particularly good result, the mean distance D of the notches 10 at a welding spot position symmetrical to D should have the following ratio with respect to the maximum depth (H2−H3) of the notches 10:

$$D/(H2-H3)=23/17.$$

For a further improvement of the elasticity without an additional decrease in stability, there may additionally be provided decoupling slots 11 symmetrical to the position of the welding spots SP3 and SP8; the mean distance D of the notches 10 to the mean distance E of the decoupling slots 11 should have the following ratio:

$$D/E=23/50.$$

For an optimum result the following ratio should be observed for the maximum depth (H2−H1) of the decoupling slots 11 relative to the maximum depth (H2−H3) of the notches 10:

$$(H2-H1)/(H2-H3)=11/17.$$

The following is applicable to the ratio of the width A of the notches 10 to the width C of the decoupling slots 11:

$$A/C=9/4.$$

We claim:

1. A color picture tube comprises a mask-frame combination which includes a rectangular frame (1) of a first material and a mask (2) of a second material, with said mask being connected to said frame by a plurality of welding spots and having a mask flange, wherein said mask-frame combination has a pair of longer sides and a pair of shorter sides, and each of said shorter sides has one of said welding spots (SP3, SP8), and wherein notches (10) are provided at both sides of said welding spot (SP3, SP8) of each of said shorter sides, with approximately the following ratio being applicable for a maximum depth (H2−H3) of each of said notches relative to a distance (H3) from an upper edge (13) of said mask flange (7) to a height (H2) of said mask flange (7):

$$H3/H2=1/3$$

wherein:

H3 equals the distance between the maximum depth of each of said notches (1) and the upper edge (13) of said mask flange (7); and H2 equals the height of the mask flange (7).

2. A color picture tube according to claim 1, wherein, for each of said shorter sides, said notches (10) each have a width (A) which has the following ratio to a remaining width (B) of said mask flange (7) between said notches (10):

$$A/B=2/3$$

wherein:

A equals the width of each of said notches; and

B equals the width of a welding web around the corresponding welding spot between said notches (10).

3. A color picture tube according to claim 1, wherein a mean distance (D) of said notches (10) to the maximum depth (H2−H3) of each of said notches (10) has the following ratio:

$$D/(H2-H3)=23/17,$$

wherein:

D equals the mean distance of the notches (10) located at both sides of each of said welding spots of said shorter sides; and (H2−H3) equals the maximum depth of each of said notches (10).

4. A color picture tube according to claim 1, wherein a pair of decoupling slots (11) are provided at specific distances outside of outer sides of said notches with respect to each of said welding spots (SP3, SP8) of said shorter sides, and a mean distance E of said pair of decoupling slots has the following ratio to a mean distance D of said notches (10):

$$D/E=23/50,$$

wherein:

D equals the mean distance of the notches (10); and

E equals the mean distance of the decoupling slots (11).

5. A color picture tube according to claim 4, wherein a maximum depth (H2−H1) of each of the decoupling slots (11) to the maximum depth (H2−H3) of each of said notches (1) has the following ratio:

$$(H2-H1)/(H2-H3)=11/17;$$

wherein:

(H2−H1) equals the maximum depth of each of said decoupling slots (11); and (H2−H3) equals the maximum depth of each of said notches (10).

6. A color picture tube according to claim 4, wherein a width (A) of each of said notches (10) has the following ratio to a width (C) of each of said decoupling slots (11):

$$A/C=9/4,$$

wherein:

A equals the width of each of said notches (10); and

C equals the width of each of said decoupling slots (11).

7. A color picture tube according to claim 1, wherein said mask flange (7) rests on and is welded to an inside of said frame (1), and said mask-frame combination has one of said welding spots (SP2, SP4, SP7, SP9) in each of the four corners, and at least one of said welding spots (SP1, SP5, SP6, SP10) at each of said longer sides.

8. A color picture tube according to claim 2, wherein a mean distance (D) of said notches (10) to the maximum depth (H2−H3) of each of said notches (10) has the following ratio:

$$D/(H2-H3)=23/17,$$

wherein:

D equals the mean distance of the notches (10) located at both sides of each of said welding spots of said shorter sides; and (H2−H3) equals the maximum depth of each of said notches (10).

9. A color picture tube according to claim 2, wherein a pair of decoupling slots (11) are provided at specific distances outside of outer sides of said notches with respect to each of said welding spots (SP3, SP8) of said shorter sides, and a mean distance E of said pair of decoupling slots has the following ratio to a mean distance D of said notches (10):

$$D/E=23/50,$$

wherein:

D equals the mean distance of the notches (10); and

E equals the mean distance of the decoupling slots (11).

10. A color picture tube according to claim 3, wherein a pair of decoupling slots (11) are provided at specific distances outside of outer sides of said notches with respect to each of said welding spots (SP3, SP8) of said shorter sides, and a mean distance E of said pair of decoupling slots has the following ratio to the mean distance D of said notches (10):

$$D/E=23/50,$$

wherein:

D equals the mean distance of the notches (10); and

E equals the mean distance of the decoupling slots (11).

11. A color picture tube according to claim 5, wherein a maximum depth (H2−H1) of each of the decoupling slots (11) to the maximum depth (H2−H3) of each of said notches (1) has the following ratio:

$$(H2-H1)/(H2-H3)=11/17;$$

wherein:

(H2−H1) equals the maximum depth of each of said decoupling slots (11); and (H2−H3) equals the maximum depth of each of said notches (10).

12. A color picture tube according to claim 2, wherein said mask flange (7) rests on and is welded to an inside of said frame (1), and said mask-frame combination has one of said welding spots (SP2, SP4, SP7, SP9) in each of the four corners, and at least one of said welding spots (SP1, SP5, SP6, SP10) at each of said longer sides.

13. A color picture tube according to claim 3, wherein said mask flange (7) rests on and is welded to an inside of said frame (1), and said mask-frame combination has one of said welding spots (SP2, SP4, SP7, SP9) in each of the four corners, and at least one of said welding spots (SP1, SP5, SP6, SP10) at each of said longer sides.

14. A color picture tube according to claim 4, wherein said mask flange (7) rests on and is welded to an inside of said frame (1), and said mask-frame combination has one of said welding spots (SP2, SP4, SP7, SP9) in each of the four corners, and at least one of said welding spots (SP1, SP5, SP6, SP10) at each of said longer sides.

15. A color picture tube according to claim 5, wherein said mask flange (7) rests on and is welded to an inside of said frame (1), and said mask-frame combination has one of said welding spots (SP2, SP4, SP7, SP9) in each of the four corners, and at least one of said welding spots (SP1, SP5, SP6, SP10) at each of said longer sides.

16. A color picture tube according to claim 6, wherein said mask flange (7) rests on and is welded to an inside of said frame (1), and said mask-frame combination has one of said welding spots (SP2, SP4, SP7, SP9) in each of the four corners, and at least one of said welding spots (SP1, SP5, SP6, SP10) at each of said longer sides.

* * * * *